US006598590B1

(12) United States Patent
Mahr

(10) Patent No.: US 6,598,590 B1
(45) Date of Patent: Jul. 29, 2003

(54) FUEL INJECTION FOR AN INTERNAL COMBUSTION ENGINE, WITH A HIGH-PRESSURE PUMP AND TWO PRESSURE RESERVOIRS

(75) Inventor: Bernd Mahr, Plochingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/700,277

(22) PCT Filed: Jan. 26, 2000

(86) PCT No.: PCT/DE00/00213

§ 371 (c)(1),
(2), (4) Date: Dec. 29, 2000

(87) PCT Pub. No.: WO00/55498

PCT Pub. Date: Sep. 21, 2000

(30) Foreign Application Priority Data

Mar. 12, 1999 (DE) ..... 199 10 971

(51) Int. Cl.[7] ..... F02M 37/04
(52) U.S. Cl. ..... 123/447; 123/514
(58) Field of Search ..... 123/467, 447, 123/456, 458, 514, 446, 299, 300

(56) References Cited

U.S. PATENT DOCUMENTS 5,168,855 A * 12/1992 Stone ..... 123/446
5,622,152 A * 4/1997 Ishida ..... 123/446
5,732,679 A * 3/1998 Takahasi et al. ..... 123/467
5,771,865 A * 6/1998 Ishida ..... 123/467
5,842,452 A * 12/1998 Pattanaik ..... 123/467
6,244,250 B1 * 6/2001 Hlousek ..... 123/467
6,328,017 B1 * 12/2001 Heinz et al. ..... 123/467

FOREIGN PATENT DOCUMENTS

EP 0 740 067 * 1/1997
EP 0 887 544 * 12/1998

* cited by examiner

*Primary Examiner*—Carl S. Miller
(74) *Attorney, Agent, or Firm*—Ronald E. Greigg

(57) ABSTRACT

In a fuel injection system for an internal combustion engine, having at least two different, high system pressures, in which a first pressure reservoir, supplied by a high-pressure pump, is provided for the higher system pressure, and a second pressure reservoir is provided for the lower system pressure, and at least the first pressure reservoir can be made to communicate by line for a fuel injection with the injectors of the individual cylinders of the engine, the pressure level of the high-pressure pump is greater than the higher system pressure, and the first pressure reservoir has an overpressure valve leading to the second pressure reservoir, and the second pressure reservoir has an overpressure valve leading to the fuel tank.

15 Claims, 1 Drawing Sheet

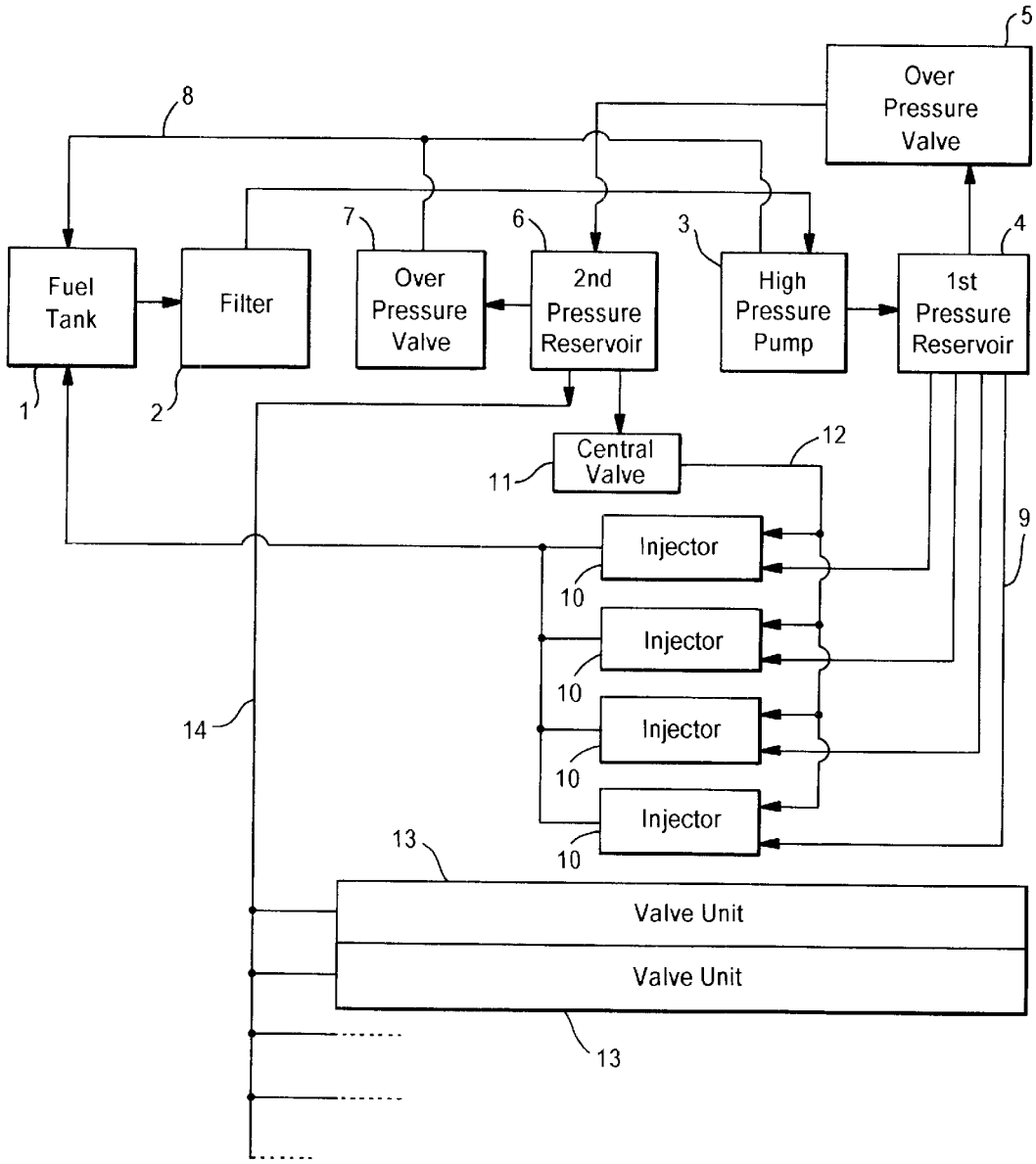
Over Pressure Valve
5
8
Fuel Tank
Filter
Over Pressure Valve
7
2nd Pressure Reservoir
6
High Pressure Pump
3
1st Pressure Reservoir
4
1
2
Central Valve
11
12
Injector
10
Injector
10
Injector
10
Injector
10
9
14
13
Valve Unit
Valve Unit
13

FUEL INJECTION FOR AN INTERNAL COMBUSTION ENGINE, WITH A HIGH-PRESSURE PUMP AND TWO PRESSURE RESERVOIRS

CROSS-REFERENCE TO RELATED APPLICATIONS

This is a 35 USC 371 application of PCT/DE 00/00213 filed on Jan. 26, 2000.

PRIOR ART

The invention is based on a fuel injection system for an internal combustion engine, the fuel injection system having a high pressure pump which, in combination with two overpressure valves, supplies fuel to the injection system at different pressures.

One such fuel injection system is disclosed for instance in European Patent Disclosure EP 0 711 914 A1.

The use of fuel injection systems with pressure reservoirs is known in Diesel engines and in direct gasoline injection engine. These systems employ a high-pressure pump and sometimes a prefeed pump which prefeed pump supplies fuel at pressures of up to about 10 bar. Systems with intake throttle regulation are also known.

In the injectors for the injection of the Diesel fuel, a distinction is presently made between stroke- and pressure-controlled systems. In a pressure-controlled fuel injection system, a valve body (such as a nozzle needle) is opened by the fuel pressure in the nozzle chamber of the injector counter to the action of a closing force, and a nozzle opening is thus uncovered for an injection of the fuel. In a stroke-controlled fuel injection system, the opening and closing of the injection opening is effected with the aid of a valve body on the basis of the hydraulic cooperation of two fuel pressures in the nozzle chamber and in a control chamber. The pressure at which fuel emerges from the nozzle chamber into the cylinder is called the injection pressure, while the pressure at which the fuel is available or is stored in the injection system is called the system pressure. As for the injectors, there are also injection nozzles with a variable injection port cross section (vario-nozzle) and with a two-stage nozzle needle stroke.

In the pressure-controlled injection system known from EP 0 711 914 A1, fuel is compressed with the aid of a high-pressure pump to a first, high system pressure of about 1200 bar and stored in a first pressure reservoir. The fuel at high pressure is also fed into a second pressure reservoir, in which by regulation of its fuel delivery by means of a 2/2-way valve, a second high system pressure of approximately 400 bar is maintained. Via a valve control unit, then either the lower or the higher system pressure is carried into the nozzle chamber of an injector. There, a spring-loaded valve body is lifted from its valve seat by the pressure, so that fuel can emerge from the nozzle opening.

ADVANTAGES OF THE INVENTION

In this injection system, the high-pressure pump generates a pressure level and quantity of fuel which is above the maximum required for full-load of the engine. This high pressure fuel is supplied to a first reservoir. A pressure limiter or regulator is positioned at the first high pressure reservoir, and regulates the pressure thereof to maintain pressure at this stage at about 800 to about 1800 bar. This first reservoir is called the second high-pressure stage due to its being the higher of the pressures of the system. The first regulator releases the excess quantity of fuel into a second pressure reservoir. This second reservoir is maintained at about 200–1000 bar by a second regulator, which is positioned between this second reservoir and the fuel tank. Fuel in this second reservoir is said to be in the first stage because the pressure is lower than that of the second stage.

The pressure of the first high-pressure stage, which is maintained preferably at approximately 200 bar, can be utilized to enable a hydraulic valve adjustment of the inlet and outlet valves, an adjustment of the camshaft association, an actuation of engine braking systems, and so forth. Also with the pressure of the first high-pressure stage, a preinjection and/or a postinjection can be achieved.

For certain applications, such as in Otto engines, a hydraulic pressure step-up from lubricating oil to fuel, or vice versa, can be done selectively from the first and second high-pressure stages. There is also the capability of using the pressure from the first high-pressure stage to control the opening cross section or to trigger injection nozzles under stroke or pressure control. The control of the stroke can be done quite simply via. pressure/travel against a spring force or via a fixed stop. The pressures can be switched via piezoelectric or magnet valves, and the control pressure for all the cylinders can be switched either centrally via one valve or locally via a plurality of valves. For triggering the injection nozzles, their leaking oil line is optionally also suitable. With this control pressure of the first high-pressure stage, a vario-nozzle can for instance also be triggered. The system is suitable for both Otto and Diesel engines.

The fuel injection system of the invention furthermore enables the following:

- control of systems present in the engine, such as inlet and outlet devices, via the fuel system.
- a compact structure. Piezoelectric or magnet valves can be provided on the pressure reservoir or pressure reservoirs and need not be disposed directly in or on the nozzle holder in the cylinder head.
- triggering of injection nozzles under pressure or stroke control and which can be infinitely variably, or alternatively can be controlled or via a stroke stop, regardless of the injection pressure.
- low amount of electrical power only be used for actuating piezoelectric or magnet valves, since low control pressures and short travel distances are possible.
- a modular design.
- the system allows for varying injection onset, and both preinjection and postinjection are therefore possible.
- the use of the pressure of the first high-pressure stage for a preinjection and/or postinjection. Because of the low injection pressure, soot development and oil thinning are largely avoided.

Further advantages and advantageous features of the subject of the invention can be learned from the description, drawing and claims.

BRIEF DESCRIPTION OF THE DRAWING

One exemplary embodiment of the fuel injection system according to the invention is schematically shown in the drawing and explained in the ensuing description.

The sole drawing FIGURE shows a fuel injection system of a four-cylinder engine with one high-pressure pump and two pressure reservoirs.

DESCRIPTION OF THE EXEMPLARY EMBODIMENT

In the injection system shown in the drawing, fuel from a fuel tank 1 via a filter 2 is compressed by means of a high-pressure pump 3 to a pressure of 1800 bar, for instance, and pumped into a first pressure reservoir, such as a rail. The pressure prevailing there is limited or regulated to a high system pressure, donated as the second high-pressure stage, for instance of 1500 bar via an overpressure valve 5. The pressure level of the high-pressure pump 3 is accordingly greater than this system pressure, and also the fuel supply quantity of the high-pressure pump 3 is greater than the fuel quantity required at full load,. The excess quantity is directed via the overpressure valve 5 into a second pressure reservoir 6, such as a rail. The pressure prevailing there is limited to a lower system pressure the first high-pressure stage, for instance at about 200 bar, via an overpressure valve 7, which regulates the fuel return to the fuel tank 1 via a leakage line 8. This leakage line 8 is also utilized by the high-pressure pump 3.

The fuel located in the first pressure reservoir 4 is lead via four lines 9 to the injectors 10 of the four cylinders and is injected there into the combustion chamber of the respective cylinder. Under the control of central valve 11, the fuel located in the second pressure reservoir 6 can be used, via a common line 12 leading to the injectors 10, for a preinjection and/or postinjection. In addition, the lower system pressure can be used to trigger valves 13 for a hydraulic adjustment of the inlet and outlet valves, an adjustment of the camshaft association, an actuation of engine braking systems, and so forth, via a line 14.

The valves 11, 13 can be embodied as piezoelectric or magnet valves.

The foregoing relates to a preferred exemplary embodiments of the invention, it being understood that other variants and embodiments thereof are possible within the spirit and scope of the invention, the latter being defined by the appended claims.

I claim:

1. A fuel injection system for an internal combustion engine, having at least two different, high system pressures, having a first pressure reservoir (4), supplied by a high-pressure pump (3), for the higher system pressure, and having a second pressure reservoir (6) for the lower system pressure, in which the first pressure reservoir (4) and the second pressure reservoir (6) can alternatively be made to communicate by line with the injectors (10) of the individual cylinders of the engine for fuel injection with either the higher or the lower high system pressures, the pressure level of the high-pressure pump (3) is greater than the higher system pressure, and that the first pressure reservoir (4) has an overpressure valve (5) leading to the second pressure reservoir (6), and the second pressure reservoir (6) has an overpressure valve (7).

2. The fuel injection system of claim 1, wherein the overpressure valve (7) of the second pressure reservoir (6) is connected to a leakage line (8).

3. A fuel injection system for an internal combustion engine, having at least two different, high system pressures, having a first pressure reservoir (4), supplied by a high-pressure pump (3), for the higher system pressure, and having a second pressure reservoir (6) for the lower system pressure, in which the first pressure reservoir (4) and the second pressure reservoir (6) can alternatively be made to communicate by line with the injectors (10) of the individual cylinders of the engine for fuel injection with either the higher or the lower high system pressures, the pressure level of the high-pressure pump (3) is greater than the higher system pressure, and that the first pressure reservoir (4) has an overpressure valve (5) leading to the second pressure reservoir (6), and the second pressure reservoir (6) has an overpressure valve (7), wherein the individual injectors (10) communicate with the second pressure reservoir (6) via one central valve unit (11).

4. The fuel injection system of claim 3, wherein the second pressure reservoir (6) communicates via one or more valve units (13) with at least one hydraulic control unit of the fuel injection system.

5. The fuel injection system of claim 2, wherein the individual injectors (10) communicate with the second pressure reservoir (6) via one central valve unit (11).

6. A fuel injection system for an internal combustion engine, having at least two different, high system pressures, having a first pressure reservoir (4), supplied by a high-pressure pump (3), for the higher system pressure, and having a second pressure reservoir (6) for the lower system pressure, in which the first pressure reservoir (4) and the second pressure reservoir (6) can alternatively be made to communicate by line with the injectors (10) of the individual cylinders of the engine for fuel injection with either the higher or the lower high system pressures, the pressure level of the high-pressure pump (3) is greater than the higher system pressure, and that the first pressure reservoir (4) has an overpressure valve (5) leading to the second pressure reservoir (6), and the second pressure reservoir (6) has an overpressure valve (7), wherein the individual injectors (10) communicate with the second pressure reservoir (6) via respective local valve units.

7. The fuel injection system of claim 2, wherein the individual injectors (10) communicate with the second pressure reservoir (6) via respective local valve units.

8. The fuel injection system of claim 2, wherein the second pressure reservoir (6) communicates via one or more valve units (13) with at least one hydraulic control unit of the fuel injection system.

9. The fuel injection system of claim 5, wherein the second pressure reservoir (6) communicates via one or more valve units (13) with at least one hydraulic control unit of the fuel injection system.

10. The fuel injection system of claim 6, wherein the second pressure reservoir (6) communicates via one or more valve units (13) with at least one hydraulic control unit of the fuel injection system.

11. The fuel injection system of claim 7, wherein the second pressure reservoir (6) communicates via one or more valve units (13) with at least one hydraulic control unit of the fuel injection system.

12. The fuel injection system of claim 3, wherein the overpressure valve (7) of the second pressure reservoir (6) is connected to a leakage line (8).

13. The fuel injection system of claim 6, wherein the overpressure valve (7) of the second pressure reservoir (6) is connected to a leakage line (8).

14. The fuel injection system of claim 3, wherein the second pressure reservoir (6) communicates via one or more valve units (13) with at least one hydraulic control unit of the fuel injection system.

15. The fuel injection system of claim 6, wherein the second pressure reservoir (6) communicates via one or more valve units (13) with at least one hydraulic control unit of the fuel injection system.

* * * * *